US007064314B1

(12) United States Patent
Poole et al.

(10) Patent No.: US 7,064,314 B1
(45) Date of Patent: Jun. 20, 2006

(54) CONCRETE-DISPENSING COUNTER FOR READY MIX TRUCKS

(76) Inventors: Jerome Poole, 64 Santa Fe, San Francisco, CA (US) 94124; Anthony Poole, Jr., 64 Santa Fe, San Francisco, CA (US) 94124; Lonita Poole, 64 Santa Fe, San Francisco, CA (US) 94124

( * ) Notice: Subject to any disclaimer, the term of this patent is extended or adjusted under 35 U.S.C. 154(b) by 667 days.

(21) Appl. No.: 09/887,245

(22) Filed: Jun. 22, 2001

(51) Int. Cl.
*G06M 7/00* (2006.01)
*B28C 5/00* (2006.01)

(52) U.S. Cl. ..... 250/221; 366/44; 356/426

(58) Field of Classification Search ..... 250/221, 250/222.1, 223 R, 231.14, 216; 366/6, 17, 366/41, 44, 64, 142, 194; 106/654; 356/426, 356/427, 428

See application file for complete search history.

(56) References Cited

U.S. PATENT DOCUMENTS 3,565,288 A 2/1971 Shute
3,927,800 A 12/1975 Zinsmeyer et al.
4,054,194 A * 10/1977 Davis ..... 366/68
4,096,383 A 6/1978 Mancini et al.
4,239,128 A 12/1980 Longnecker
4,387,299 A 6/1983 Akiyama
4,544,275 A 10/1985 Hudelmaier
5,178,455 A * 1/1993 Ohsaki et al. ..... 366/6
5,622,163 A 4/1997 Jewett et al.

* cited by examiner

*Primary Examiner*—Kevin Pyo

(57) ABSTRACT

A concrete-dispensing counter for ready mix trucks for measuring the volume of concrete discharged by a ready mix concrete truck. The concrete-dispensing counter for ready mix trucks includes a prime mover having a drum being rotatably mounted thereupon and also having a discharge chute through which cement is dispensed from the drum; and also includes a light emitting/reflecting assembly being mounted to the prime mover and including a plurality of light reflectors being spacedly attached about an exterior of the drum opposite to the discharge chute and also including a light-emitting member and a light-detecting member being mounted to the prime mover; and further includes a microprocessor being connected to the light-emitting and the light-detecting members; and also includes a concrete-dispensing sensor being attached to the discharge chute and to the light emitting/reflecting assembly and to the microprocessor for actuating the light emitting/reflecting assembly and the microprocessor.

5 Claims, 3 Drawing Sheets

CONCRETE-DISPENSING COUNTER FOR READY MIX TRUCKS

BACKGROUND OF THE INVENTION

1. Field of the Invention

The present invention relates to concrete quantity counters for ready mix trucks and more particularly pertains to a new concrete-dispensing counter for ready mix trucks for measuring the volume of concrete discharged by a ready mix concrete truck.

2. Description of the Prior Art

The use of concrete quantity counters for ready mix trucks is known in the prior art. More specifically, concrete quantity counters for ready mix trucks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,544,275; U.S. Pat. No. 3,927,800; U.S. Pat. No. 4,239,128; U.S. Pat. No. 3,565,288; U.S. Pat. No. 5,622,163; U.S. Pat. No. 4,387,299; and U.S. Pat. No. 4,096,383.

While these devices fulfill their respective, particular objectives and requirements, the aforementioned patents do not disclose a new concrete-dispensing counter for ready mix trucks. The inventive device includes a prime mover having a drum being rotatably mounted thereupon and also having a discharge chute through which cement is dispensed from the drum; and also includes a light emitting/reflecting assembly being mounted to the prime mover and including a plurality of light reflectors being spacedly attached about an exterior of the drum opposite to the discharge chute and also including a light-emitting member and a light-detecting member being mounted to the prime mover; and further includes a microprocessor being connected to the light-emitting and the light-detecting members; and also includes a concrete-dispensing sensor being attached to the discharge chute and to the light emitting/reflecting assembly and to the microprocessor for actuating the light emitting/reflecting assembly and the microprocessor.

In these respects, the concrete-dispensing counter for ready mix trucks according to the present invention substantially departs from the conventional concepts and designs of the prior art, and in so doing provides an apparatus primarily developed for the purpose of measuring the volume of concrete discharged by a ready mix concrete truck.

SUMMARY OF THE INVENTION

In view of the foregoing disadvantages inherent in the known types of concrete quantity counters for ready mix trucks now present in the prior art, the present invention provides a new concrete-dispensing counter for ready mix trucks construction wherein the same can be utilized for measuring the volume of concrete discharged by a ready mix concrete truck.

The general purpose of the present invention, which will be described subsequently in greater detail, is to provide a new concrete-dispensing counter for ready mix trucks which has many of the advantages of the concrete quantity counters for ready mix trucks mentioned heretofore and many novel features that result in a new concrete-dispensing counter for ready mix trucks which is not anticipated, rendered obvious, suggested, or even implied by any of the prior art concrete quantity counters for ready mix trucks, either alone or in any combination thereof.

To attain this, the present invention generally comprises a prime mover-having a drum being rotatably mounted thereupon and also having a discharge chute through which cement is dispensed from the drum; and also includes a light emitting/reflecting assembly being mounted to the prime mover and including a plurality of light reflectors being spacedly attached about an exterior of the drum opposite to the discharge chute and also including a light-emitting member and a light-detecting member being mounted to the prime mover; and further includes a microprocessor being connected to the light-emitting and the light-detecting members; and also includes a concrete-dispensing sensor being attached to the discharge chute and to the light emitting/reflecting assembly and to the microprocessor for actuating the light emitting/reflecting assembly and the microprocessor.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new concrete-dispensing counter for ready mix trucks which has many of the advantages of the concrete quantity counters for ready mix trucks mentioned heretofore and many novel features that result in a new concrete-dispensing counter for ready mix trucks which is not anticipated, rendered obvious, suggested, or even implied by any of the prior art concrete quantity counters for ready mix trucks, either alone or in any combination thereof.

It is another object of the present invention to provide a new concrete-dispensing counter for ready mix trucks which may be easily and efficiently manufactured and marketed.

It is a further object of the present invention to provide a new concrete-dispensing counter for ready mix trucks which is of a durable and reliable construction.

An even further object of the present invention is to provide a new concrete-dispensing counter for ready mix trucks which is susceptible of a low cost of manufacture with regard to both materials and labor, and which accordingly is then susceptible of low prices of sale to the consuming public, thereby making such concrete-dispensing counter for ready mix trucks economically available to the buying public.

Still yet another object of the present invention is to provide a new concrete-dispensing counter for ready mix trucks which provides in the apparatuses and methods of the prior art some of the advantages thereof, while simultaneously overcoming some of the disadvantages normally associated therewith.

Still another object of the present invention is to provide a new concrete-dispensing counter for ready mix trucks for measuring the volume of concrete discharged by a ready mix concrete truck.

Yet another object of the present invention is to provide a new concrete-dispensing counter for ready mix trucks which includes a prime mover having a drum being rotatably mounted thereupon and also having a discharge chute through which cement is dispensed from the drum; and also includes a light emitting/reflecting assembly being mounted to the prime mover and including a plurality of light reflectors being spacedly attached about an exterior of the drum opposite to the discharge chute and also including a light-emitting member and a light-detecting member being mounted to the prime mover; and further includes a microprocessor being connected to the light-emitting and the light-detecting members; and also includes a concrete-dispensing sensor being attached to the discharge chute and to the light emitting/reflecting assembly and to the microprocessor for actuating the light emitting/reflecting assembly and the microprocessor.

Still yet another object of the present invention is to provide a new concrete-dispensing counter for ready mix trucks that is easy and convenient to use.

Even still another object of the present invention is to provide a new concrete-dispensing counter for ready mix trucks that improves the accuracy and speed of determining quantities of concrete being dispensed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
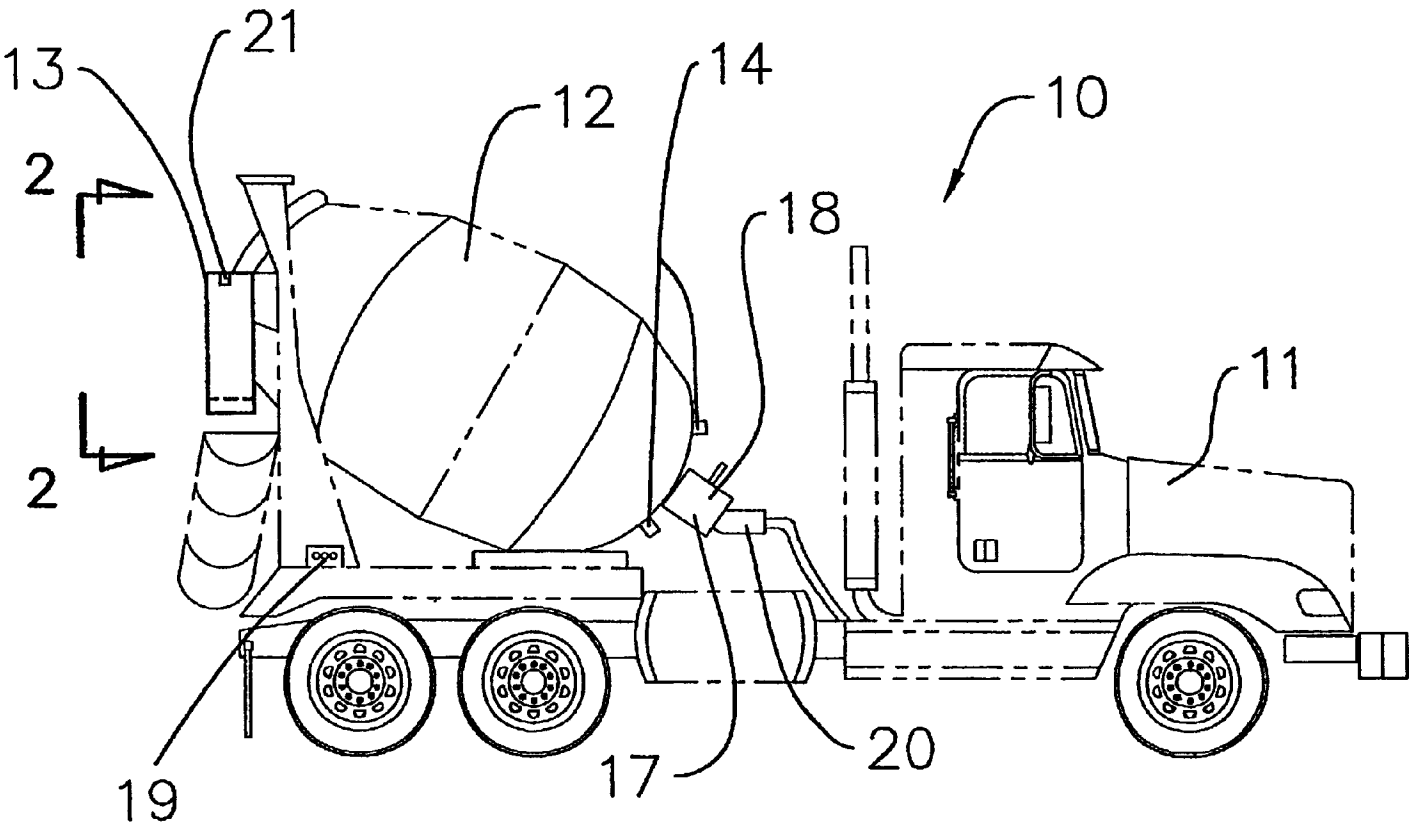
FIG. 1 is a side elevational view of a new concrete-dispensing counter for ready mix trucks according to the present invention.
Figure 2:
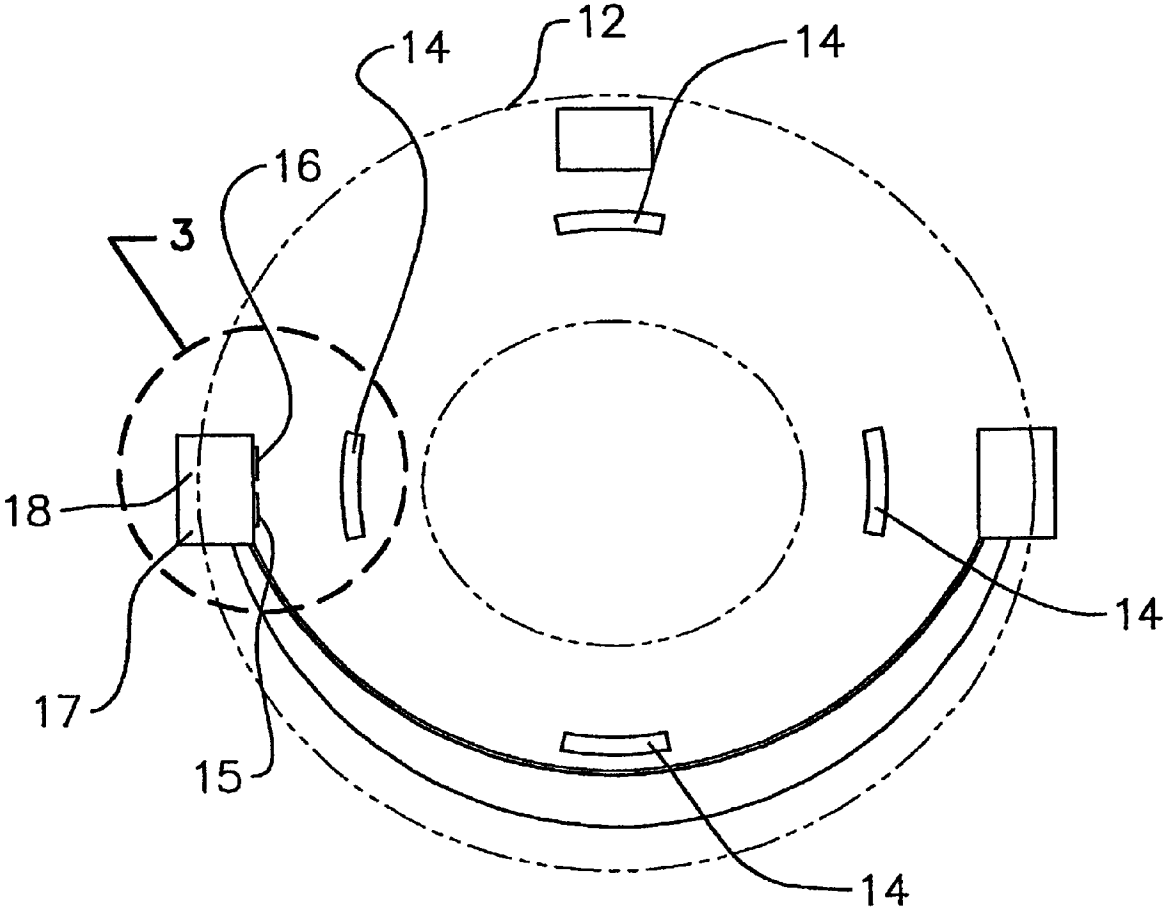
FIG. 2 is a side elevational view of the present invention.
Figure 3:
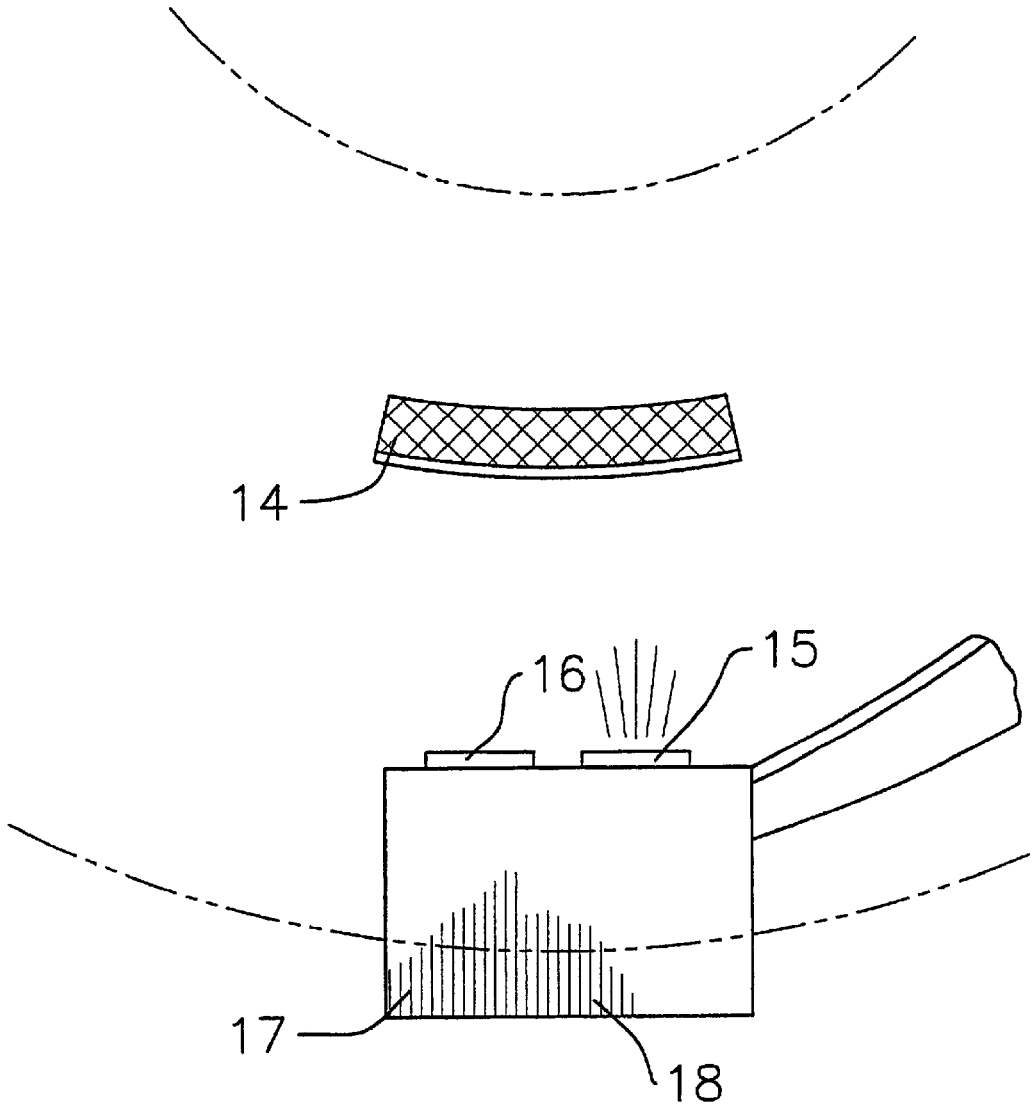
FIG. 3 is a detailed top plan view of microprocessor and light emitting/detecting assembly of the present invention.

With reference now to the drawings, and in particular to FIGS. 1 through 3 thereof, a new concrete-dispensing counter for ready mix trucks embodying the principles and concepts of the present invention and generally designated by the reference numeral 10 will be described.

As best illustrated in FIGS. 1 through 3, the concrete-dispensing counter for ready mix trucks 10 generally comprises a prime mover 11 having a drum 12 being rotatably and conventionally mounted thereupon and also having a discharge chute 13 through which cement is dispensed from the drum 12. A light emitting/reflecting assembly is conventionally mounted to the prime mover 11 and includes a plurality of plate-like light reflectors 14 being spacedly and conventionally attached about an exterior of the drum 12 opposite to the discharge chute 13, and also includes a light-emitting member 15 and a light-detecting member 16 being conventionally mounted to the prime mover 11.

A microprocessor 17 is conventionally connected to the light-emitting 15 and the light-detecting members 16. The microprocessor 17 includes a housing 18. The light-emitting and light-detecting members 15, 16 are conventionally disposed in the housing 18 and are directed toward the light reflectors 14. The light-detecting member 16 is a photosensor. The housing 18 is conventionally mounted upon a casing 20 disposed about a motor which drives the drum 12. A concrete-dispensing sensor 21 such as a conventional optical, mechanical or conductive sensor is conventionally attached to the discharge chute 13 and to the light emitting/reflecting assembly and to the microprocessor 17 with wires (not shown) for actuating the light emitting/reflecting assembly and the microprocessor 17. A conventional display counter 19 is conventionally mounted upon the prime mover 11 and is conventionally connected to the microprocessor 17 for counting quarter turns of the drum 12.

In use, as cement or concrete is being dispensed from the drum 12 through the discharge chute 13, the concrete-dispensing sensor 21 actuates the microprocessor 17 and the light-emitting and light-detecting members 15,16; whereupon the microprocessor 17 records the number of quarter turns of the drum 12 and the number is displayed on the display counter 19 so that the user can keep an accurate record of the number of yards of concrete or cement is being dispensed from the drum 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A concrete-dispensing counter for a ready mix truck comprising:

a prime mover having a drum being rotatably mounted thereupon and also having a discharge chute through which cement is dispensed from said drum;

a light emitting/reflecting assembly being mounted to said prime mover and including a plurality of light reflectors being spacedly attached about an exterior of said drum opposite to said discharge chute and also including a light-emitting member and a light-detecting member being mounted to said prime mover;

a microprocessor being connected to said light-emitting and said light-detecting members;

a concrete-dispensing sensor being attached to said discharge chute and to said light emitting/reflecting assembly and said microprocessor for actuating said light emitting/reflecting assembly and said microprocessor; and a display counter being mounted upon the prime mover and being connected to the microprocessor for counting quarter turns of the drum.

2. A concrete-dispensing counter for a ready mix truck as described in claim 1, said microprocessor includes a housing, said light-emitting and light-detecting members being disposed in said housing and being directed toward said light reflectors.

3. A concrete-dispensing counter for a ready mix truck as described in claim 2, wherein said light-detecting member is a photo-sensor.

4. A concrete-dispensing counter for a ready mix truck as described in claim 3, wherein said housing is mounted upon a casing disposed about a motor which drives said drum.

5. A concrete-dispensing counter for a ready mix truck comprising:

a prime mover having a drum being rotatably mounted thereupon and also having a discharge chute through which cement is dispensed from said drum;

a light emitting/reflecting assembly being mounted to said prime mover and including a plurality of light reflectors being spacedly attached about an exterior of said drum opposite to said discharge chute and also including a light-emitting member and a light-detecting member being mounted to said prime mover;

a microprocessor being connected to said light-emitting and said light-detecting members, said microprocessor including a housing, said light-emitting and light-detecting members being disposed in said housing and being directed toward said light reflectors, said light-detecting member being a photo-sensor, said housing being mounted upon a casing disposed about a motor which drives said drum;

a concrete-dispensing sensor being attached to said discharge chute and to said light emitting/reflecting assembly and said microprocessor for actuating said light emitting/reflecting assembly and said microprocessor; and a display counter being mounted upon the prime mover and being connected to the microprocessor for counting quarter turns of the drum.

* * * * *